US011773661B2

(12) United States Patent
Simões et al.

(10) Patent No.: US 11,773,661 B2
(45) Date of Patent: Oct. 3, 2023

(54) OFF SHORE RISER FIXATION SYSTEM AND METHOD

(71) Applicant: SAIPEM S.P.A., Milan (IT)

(72) Inventors: Sergio Simões, Milan (IT); Otávio Borges Sertã, Milan (IT)

(73) Assignee: SAIPEM S.P.A., San Donato Milanese (IT)

( * ) Notice: Subject to any disclaimer, the term of this patent is extended or adjusted under 35 U.S.C. 154(b) by 0 days.

(21) Appl. No.: 17/641,755

(22) PCT Filed: Sep. 9, 2019

(86) PCT No.: PCT/IB2019/057581
§ 371 (c)(1),
(2) Date: Mar. 9, 2022

(87) PCT Pub. No.: WO2021/048592
PCT Pub. Date: Mar. 18, 2021

(65) Prior Publication Data

US 2022/0316285 A1 Oct. 6, 2022

(51) Int. Cl.
*E21B 19/00* (2006.01)

(52) U.S. Cl.
CPC ..... *E21B 19/004* (2013.01); *E21B 19/008* (2013.01)

(58) Field of Classification Search
CPC ..... E21B 19/004; E21B 19/008
See application file for complete search history.

(56) References Cited

U.S. PATENT DOCUMENTS 5,437,518 A * 8/1995 Maloberti ..... E21B 43/0135 405/169
5,947,642 A 9/1999 Teixeira et al.
6,695,542 B2 * 2/2004 Strømberg ..... E21B 19/24 166/341

(Continued)

FOREIGN PATENT DOCUMENTS

EP 3 473 801 A1 4/2019
WO 2017/034409 A1 3/2017

OTHER PUBLICATIONS

International Search Report and Written Opinion of the International Searching Authority for International Patent Application No. PCT/IB2019/057581 dated May 26, 2020, 9 pages.

*Primary Examiner* — Matthew R Buck
(74) *Attorney, Agent, or Firm* — Merchant & Gould P.C.

(57) ABSTRACT

A method approximates and connects an off shore riser duct to a floating unit, includes installing a tubular coupling recipient on the floating unit at a riser coupling level, the coupling recipient having an annular side wall extending around a longitudinal axis. A pulling device is on the floating unit at a pulling device level above the riser coupling level. The pulling device pulls a line extended through the coupling recipient and connected to a pulling head at a riser duct upper end. The riser duct upper end is pulled into the coupling recipient, providing a locking mechanism to lock a coupling adapter against downward withdrawal. Extending the line along a curved deviating surface deviates the pulling direction. The curved deviating surface is formed by a deviating member connected to the coupling recipient at a distance from the longitudinal axis smaller than an annular side wall to longitudinal axis distance.

32 Claims, 13 Drawing Sheets

(56) References Cited

U.S. PATENT DOCUMENTS

| | | | | |
|---|---|---|---|---|
| 7,293,940 | B1 | 11/2007 | Perreau-Saussine et al. | |
| 7,373,986 | B2 * | 5/2008 | Pollack | F16B 21/04 166/359 |
| 2006/0070741 | A1 | 4/2006 | Pollack et al. | |
| 2018/0258711 | A1 | 9/2018 | Otten et al. | |

* cited by examiner

FIG. 10
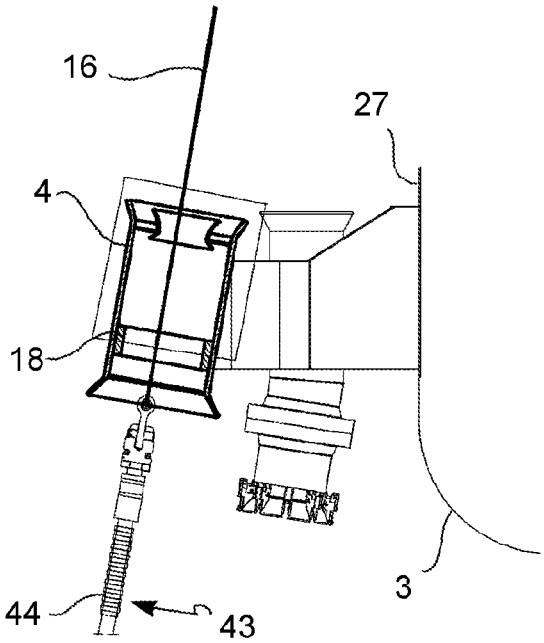
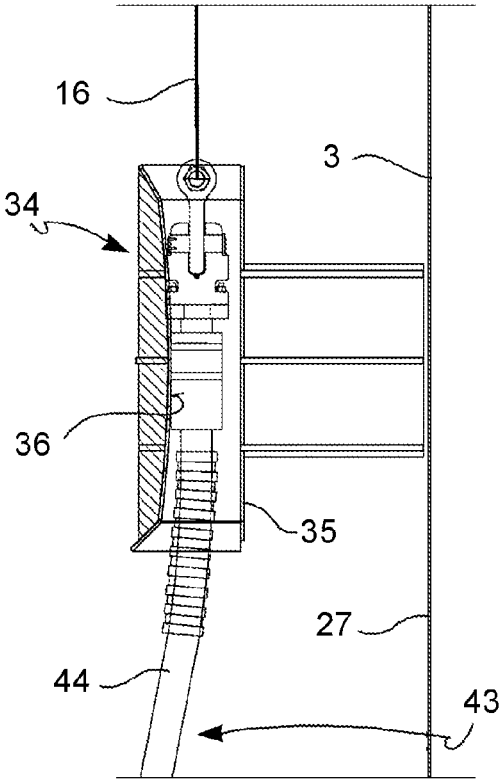
FIG. 11
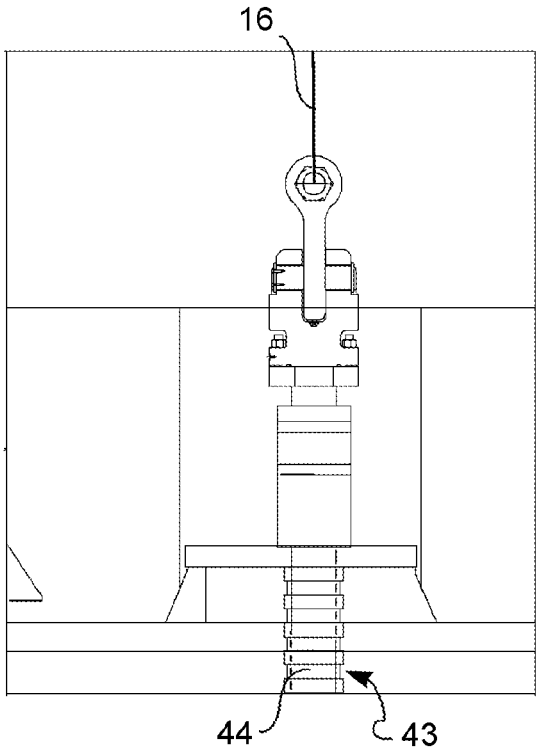
FIG. 12

OFF SHORE RISER FIXATION SYSTEM AND METHOD

This application is a National Stage Application of PCT/IB2019/057581, filed 9 Sep. 2019, and which application is incorporated herein by reference. To the extent appropriate, a claim of priority is made to the above-disclosed application.

BACKGROUND OF THE INVENTION

The present invention relates to an off shore riser fixation system and method.

In a typical configuration of deep sea oil and gas production installations an assembly of valves and fittings used to regulate the inflow and outflow of products from and to a well, so called trees, are positioned on the seabed and floating units, so-called Floating Production Storage Offloading ("FPSO") facilities, are positioned at sea level. The trees are fluidically connected with the Floating Production Storage Offloading ("FPSO") facilities by rigid or flexible oil or gas conveying pipes, the so-called risers, which extend from the seabed up to sea level.

This configuration allows increased flexibility in field layouts, such as multiple individual wells and multiple drill centers, and reduces the interferences within the main field construction phases: drilling, pipelay and FPSO fabrication. Once the underwater exploitation field has been completed, the floating (FPSO) unit can approach its target location, where the floating unit is anchored by means of a mooring that is normally pre-installed on the seabed. Then the upper ends of the risers are moved toward and connected to the floating unit (FPSO) to transport the petroleum product from the wells to the floating unit FPSO.

On the other hand, it is increasingly frequent to use or embody the risers as so-called service lines for transporting methanol or other chemical products to guarantee the flow of the petroleum product (flow assurance), or for transporting injection water for water injection in the subsea soil to increase the extraction rate of the oil or gas product in the well, that service fluid transport taking place from the floating (FPSO) unit downward towards the wells.

The configuration in which the above mentioned assembly of valves and fittings ("trees") are arranged on the sea bed (so called wet trees configuration) allows a great freedom of movement of the floating (FPSO) units compared to a configuration in which the assembly of valves and fittings is arranged on the floating unit at sea level (so-called dry trees configuration). This allows to use common floaters, e.g. standard ships such as Suezmax, Panamax, which are adapted to accommodate the oil plants, and which are anchored by means of a specific mooring system which, depending on local weather and sea conditions, can be fixed (e.g. a so called spread mooring) or rotating (e.g. a so-called turret mooring).

The movements of the FPSO are linked to those of the riser and movements and stresses are transmitted between these two structural sub-systems, differently between configurations in which the risers hang from the floater (so-called "hang off risers" which are relevant for the present invention) and configurations in which the risers are free from the FPSO (so-called "free standing riser" which are less relevant for the present invention). The movements of the FPSO induce mechanical stresses in the riser which combine with the corrosive and chemical actions thereon. Particular critical regions are the upper coupling of the riser (hang off region) as well as the support region of the riser on the seabed (touch down point).

To withstand the dynamic mechanical loads and the corrosive and chemical attack, the risers are usually made of carefully selected materials or material combinations, such as e.g. metallic materials for rigid risers, multiple metallic material layers for flexible risers, so-called umbilical duct structures with dedicated ducting tubes (umbilical) inside an external protection tube, or composite polymeric material that pipes that are used in particularly challenging projects.

Among the known possible shape and boundary conditions of the risers, there are to be listed the simple catenary shape (so-called Steel Catenary Riser "SCR") or multiple and compound catenary shapes, such as e.g. the so-called steel lazy wave catenary riser (SWLR) or the dormant riser, in which the tension of the upper portion of the riser is reduced at the expense of an increased length.

The structural hang-off interface between the riser and the floating unit, which is a relevant issue for the present invention, must withstand and influence in a desired manner the dynamics, forces and movements of the two sub-systems. Moreover, specific transfer systems and equipment is provided on the floating unit which move, hold, guide and manipulate the upper riser end to facilitate a rapid installation of the upper riser end at the floating unit without taking up precious space for the oil and gas process plants.

Such known hang-off interfaces include e.g. so-called basket interfaces and so-called I-tube interfaces.

In the "basket" support mode (which is less relevant for the present invention), the upper end of the riser forms an enlarged flexible joint portion, whereas a receptacle fixed on the floating unit forms a laterally slotted tube or laterally open saddle, into which the upper end portion of the riser is laterally inserted and then slightly lowered so that the enlarged flexible joint portion is rested in the saddle.

The necessary pulling of the riser upper end portion towards and into the laterally open saddle is carried out by means of pulling cables which need to be guided and redirected by means of redirecting pulleys installed on the floating unit above the saddle.

In the I-tube support mode (which is relevant for the present invention) the upper end of the riser forms a flexible joint portion to which an additional coupling adapter is connected, whereas a receptacle fixed on the floating unit forms a circumferentially closed tube section having an upper enlarged edge and a lower enlarged edge (therefore the name "I-tube"), into which the upper end of the riser is inserted from below until the coupling adapter is above the upper edge of the I-tube. Subsequently, in order to lock the adapter with respect to the I-tube, a locking lever mechanism at said upper edge must be activated so that locking levers of the locking lever mechanism move in between the coupling adapter and the I-tube and prevent the locking adapter from returning downwards and, hence, the riser from slipping downward out of the I-tube.

Also in this case, the necessary pulling of the riser upper end portion into the I-tube is carried out by means of a pulling cable which need to be inserted through the I-tube and additionally guided and redirected by means of redirecting pulleys installed on the floating unit above the I-tube.

The necessary transfer systems and riser manipulation equipment include e.g. pulling devices such as winches, cables, chains, pulling heads.

Further installation aids integrated in the floating unit (vessel) include e.g.:

- a pulling system positioned on the deck of the vessel and having a system of redirecting pulleys, a pulling system positioned on a main deck of the vessel in which the main deck is cantilevered, and/or a pulling system suspended from the vessel side wall, like a balcony, having sledges for moving the pulling system in the position of use thereof, a pulling system mounted on a deck mounted rotating slide (so-called rotating turret)

In order not to occupy useful space for the onboard oil and gas installations, the pulling systems are often suspended from a cantilevers (balconies) on the side of the vessel in which the pulling systems can slide on rails for a quick repositioning thereof to different riser hang-off positions. The piping contractor needs rapidly repositionable pulling systems, whereas the contractor of the floating unit doesn't want interruptions in the production line of the vessel.

A known off-shore flexible riser fixation method used for turret moored FPSO involves the following steps:

A) A messenger cable is extended through each I-tube, with a first end exiting the upper opening of the I-tube and a second end exiting the lower opening of the I-tube and extending outside the floating unit (FPSO), B) the first end of the messenger cable is connected to the head of a pull cable, C) a construction vessel, different from the floating unit (FPSO) enters the field and holds the upper end of a riser in the riser laying tower, the upper end of the riser being already equipped with a pulling head and a triplate, D) the second end of the messenger cable is passed from the floating unit to the construction vessel, E) the head of the pull cable is moved from the platform to the construction vessel, F) the pull cable is connected to an abandonment cable and to the triplate at the riser, G) the riser is lowered down the laying tower of the construction vessel and a load passage is made from the abandonment cable to the pulling cable, H) using the pulling cable, the riser is then raised towards the lower mouth of the I-tube, I) the abandonment cable is removed from the riser by divers, J) using the pulling cable, the riser is raised from below inside the lower mouth of the I-tube, K) a bend stiffener of the riser is connected to a lower connector and can be separated from the pulling head. The divers verify the distances, the condition of the guides, the insertion of the riser in the I-tube, and eventually free the blocks of the locking lever system, that had been kept open by e.g. inflated balloons or holding cables, and verify the correct engagement of the locking lever, L) the riser head is then raised and brought above spider deck level, M) the riser head is abutted on the deck by means of a fixing bar, N) the pulling system is repositioned for the next riser pull.

The described method is analogously applied both to the riser pulling and fixation on semi-submersible FPSO units and on floating FPSO units with rotatable turret.

The prior art riser pulling and fixation procedures and systems require an undesired high quantity of divers and diver dependent submarine operations, such as e.g. internal cleaning of the mouth of the I-tube, visual assistance during the insertion of the riser into the lower mouth of the I-tube, activation of the bend stiffener connector mechanism (e.g. by removal of the floating balloons), actuation of the riser support mechanism, temporary support of the bend stiffener of the upper riser end portion, installation and hydraulic connection of the pipe connection socket (the so-called spool) between upper riser end and the onboard oil or gas plant, reconfiguration of the pulling system, alignment control between riser and I-tube before and during insertion. These problems (massive involvement of divers) is common for all prior art methods referred to turret and spread moored FPSO, flexible and rigid risers.

These submarine activities carried out by divers are sensible to weather conditions and as such dangerous and unpredictable and a cause of risk of accidents and operation delays.

Moreover, for resolving the contrasting directions and orientations of approximation and insertion of the riser upper end into the I-tube, of the pulling direction of the pulling winches on the floating unit FPSO, of the orientation of the I-tube with respect to the floating unit vessel wall and of the orientation of the floating unit with respect to the riser catenary, and in order to avoid abrasive scratching of the pulling cable and of the upper riser end portion against the I-tube, the prior systems and methods require a number of pulling cable deviation gutters, which need to be temporarily installed on the vessel side wall above the I-tube at a certain vertical distance therefrom, in order to assure that the pulling cable extends clear and contactless through the I-tube without any scratching contact, and that the pulling head and the coupling adapter enter of the riser enter the I-tube truly centrally and axially aligned.

The provision and installation and removal of these deviation gutters are cost and time consuming and the alignment result is often poor, essentially due to the distance between the deviation gutter and the I-tube and due to the even greater distance between the deviation gutter and the riser upper end during the phase of riser approximation and alignment with the I-tube.

SUMMARY OF THE INVENTION

The objective of the present invention is therefore to provide an improved system and method for connecting an off shore riser duct to a floating unit FPSO.

A particular objective of the present invention is to provide a system and method for connecting an off shore riser duct to a floating unit FPSO, which has a modified pulling cable redirecting path.

A further particular objective of the present invention is to provide a system and method for connecting an off shore riser duct to a floating unit FPSO, which improves the alignment between pulling cable, riser upper end and I-tube during approximation and insertion of the riser end into the I-tube.

A further particular objective of the present invention is to provide a system and method for connecting an off shore riser duct to a floating unit FPSO, which allows to reduce the number of additional pulling cable redirecting sheaves between the I-tubes and the pulling winches, and the installation cost and time for such redirecting sheaves.

A further particular objective of the present invention is to provide a system and method for connecting an off shore riser duct to a floating unit FPSO, which allows to reduce the number of submarine diver operations.

A system for approximating and connecting an off shore riser duct to a floating unit FPSO comprises:

a tubular coupling recipient (I-tube) installed on the floating unit at a riser coupling level and adapted to receive a coupling adapter of said riser upper end, said coupling recipient having an annular side wall extending about a recipient longitudinal axis, a downward facing lower opening defined by a (preferably outwardly flared) lower end edge of the side wall, an upward facing upper opening defined by a (preferably outwardly flared) upper edge of the side wall, a pulling device installed on the floating unit at a pulling device level above said riser coupling level and adapted to pull a pulling line extended through the coupling recipient, wherein the pulling line is intended to be coupled to a pulling head at an upper end of the riser duct, so that the upper end of the riser duct is pulled upward towards the pulling device and into the coupling recipient, a locking mechanism provided at the coupling recipient for locking the coupling adapter of the riser duct against downward withdrawal from the coupling recipient, a pulling line redirecting system installed at the floating unit and comprising at least one curved deviating surface along which the pulling line is extended and at which a lower pulling line direction of the pulling line at the lower opening of the coupling recipient is deviated into an intermediate pulling line direction in a region above the lower opening of the coupling recipient.

According to an aspect of the invention, said curved deviating surface is formed by a deviating member directly connected to said coupling recipient and at a radial distance from the recipient longitudinal axis smaller than the radial distance of the annular side wall from the recipient longitudinal axis.

This configuration of the pulling line redirecting system brings the redirecting point close to the I-tube coupling recipient, thereby improving the alignment of the upper riser end with the coupling recipient, and facilitating and/or reducing or even eliminating possible further necessary redirecting of the pulling line between the coupling recipient and the pulling device.

For instance, in certain circumstances, the arrangement of the redirection surface directly at or inside the coupling recipient obviates the need and the installation cost and time of additional external redirecting sheaves.

The improved alignment of the upper riser end orientation and movement with respect to the coupling recipient also reduces the submarine operations and corrective interventions carried out by divers.

According to a further aspect of the invention, at least a lower end section of the pulling line, adjacent to the upper riser duct end, is configured as a flexible tubular pull-resistant duct stretch, adapted for conveying the petroleum product from the upper riser duct end to a production storage offloading facility onboard the floating unit, so that after locking the coupling adapter in the coupling recipient, no need arises to detach the lower end section of the pulling line from the riser duct and replace it by a different rigid ducting stretch (the so-called spool duct).

This eliminates a considerable amount of time consuming operations, particularly submarine operations carried out by divers, and interventions that require highly experienced workforce.

BRIEF DESCRIPTION OF THE DRAWINGS

These and other features and advantages of the present invention shall be made apparent from the accompanying drawings which illustrate embodiments of the invention, and, together with the general description of the invention given above, and the detailed description of the embodiments given below, serve to explain the principles of the present invention.

FIGS. 10, 11, 12 show details of the system in FIGS. 8 and 9 in subsequent method phases in accordance with an embodiment of the invention.

DETAILED DESCRIPTION OF THE PREFERRED EMBODIMENT

Figure 1:
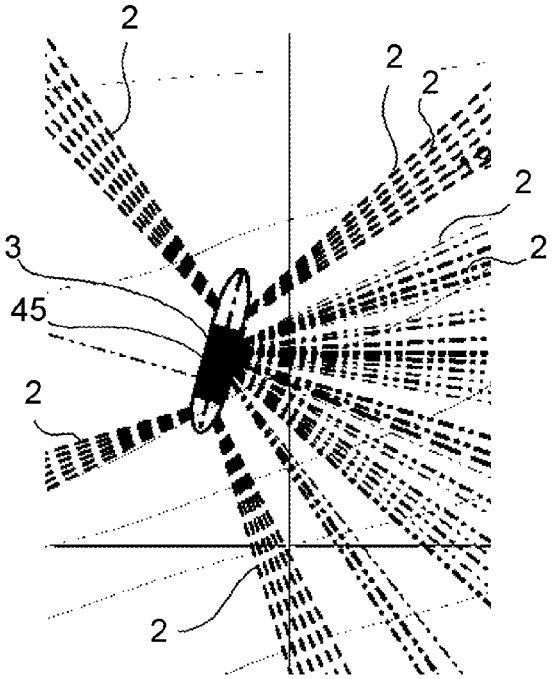
FIG. 1 illustrates a spread moored FPSO floating unit with submerged riser balcony and a number of connected riser ducts.
Figure 2:
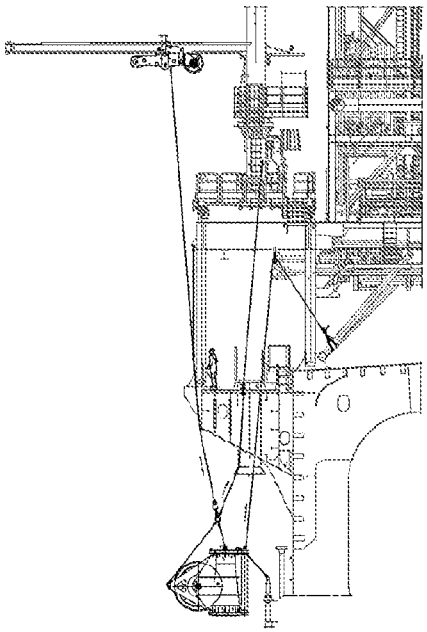
FIG. 2 illustrates the installation of a temporary pulling line redirecting sheave on a side wall of the floating unit.
Figure 3:
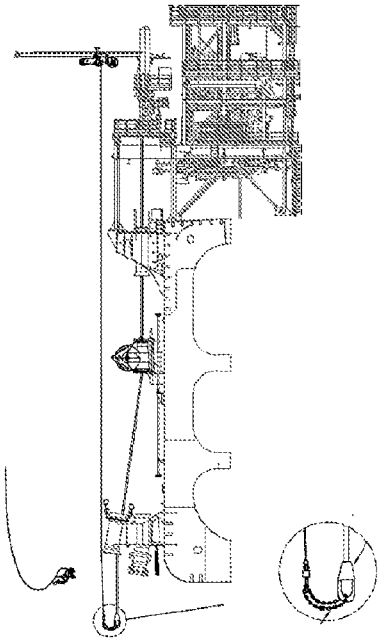
FIG. 3 illustrates a preparatory phase, involving diver operations, of a messenger cable and pulling cable for a connection of the pulling cable to a riser.
Figure 4:
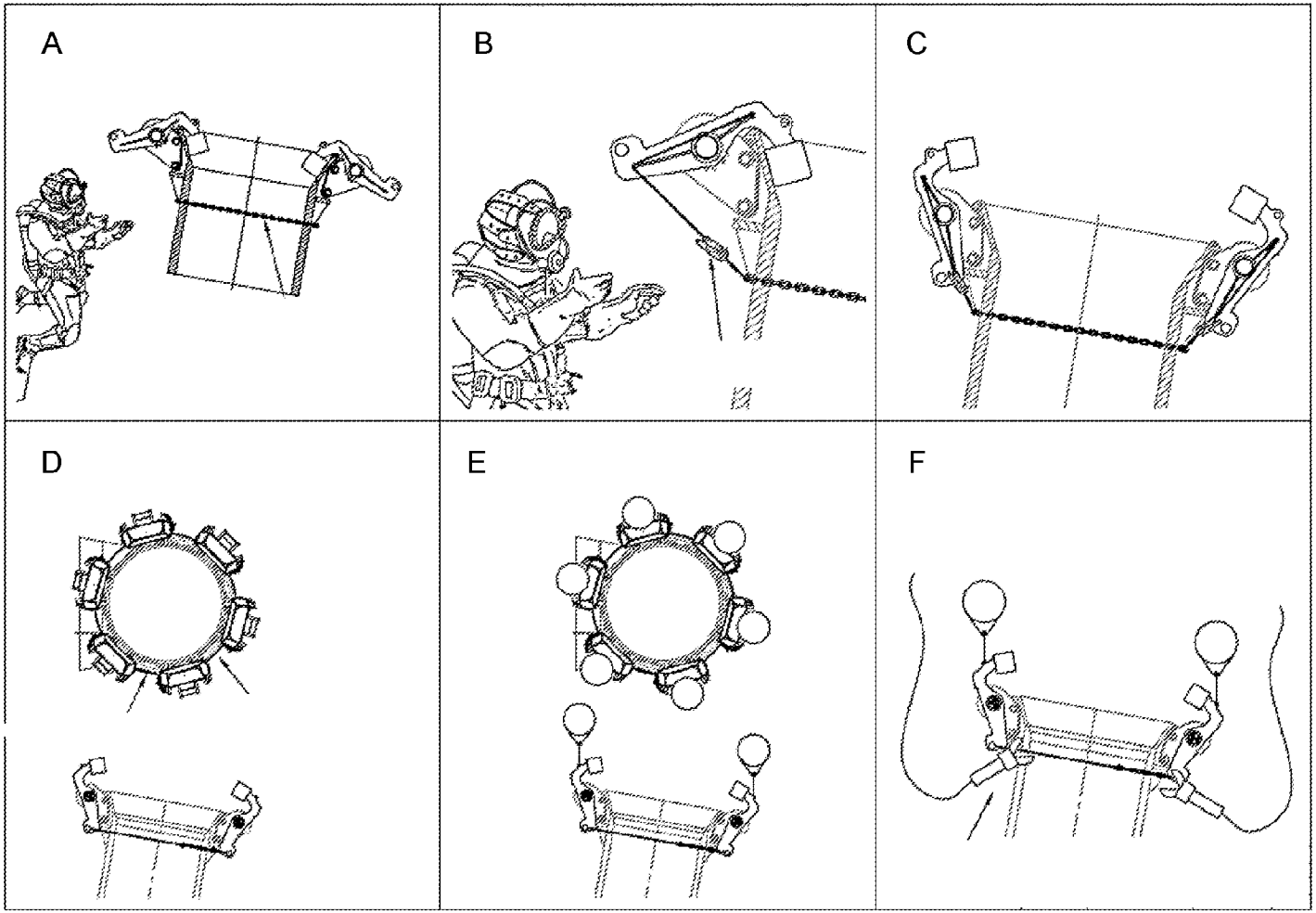
FIG. 4 PRIOR ART
FIG. 4A through F illustrate prior art operations and systems, that require intensive diver operations, for locking an upper riser end in an I-tube coupling recipient, these systems being described e.g. in WO2017034409A1.

With reference to the figures, a system 1 for approximating and connecting an off shore riser duct 2 to a floating unit FPSO 3 comprises a tubular coupling recipient 4 (I-tube) installed on the floating unit 3 at a riser coupling level 5 and adapted to receive a coupling adapter 6 of said riser duct 2 upper end 7, said coupling recipient 4 having an annular side wall 8 extending about a recipient longitudinal axis 9, a downward facing lower opening 10 defined by a (preferably outwardly flared) lower end edge 11 of the side wall 8, an upward facing upper opening 12 defined by a (preferably outwardly flared) upper end edge 13 of the side wall 8.

The system 1 further comprises a pulling device 14 installed on the floating unit 3 at a pulling device level 15 above said riser coupling level 5 and adapted to pull a pulling line 16 extended through the coupling recipient 4, wherein the pulling line 16 is intended to be coupled to a pulling head 17 at the upper end 7 of the riser duct 2, so that the upper end 7 of the riser duct 2 is pulled from below upward into the coupling recipient 4.

Figure 5:
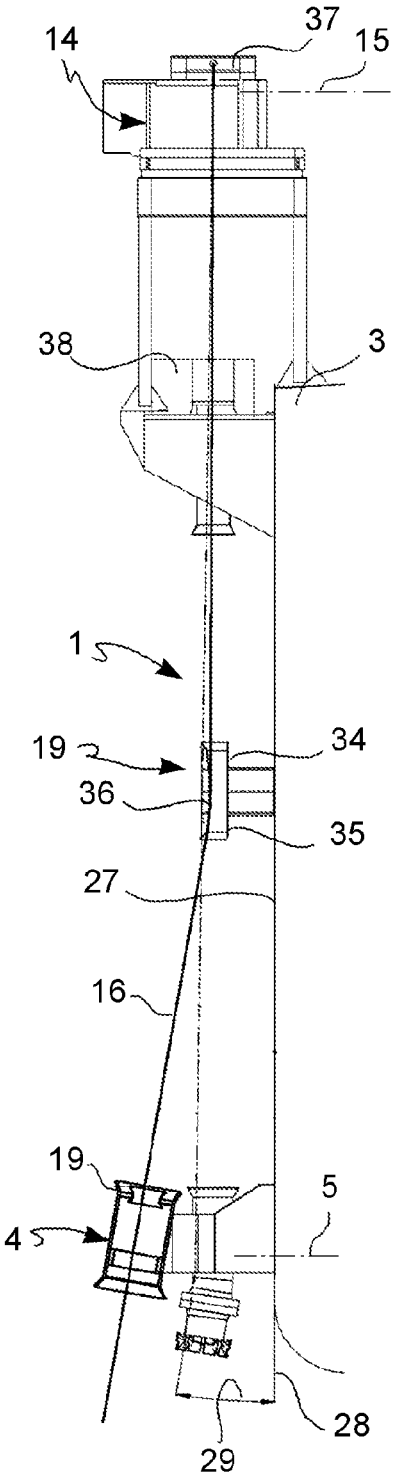
FIG. 5 shows a method phase and system for approximating and connecting an off shore riser duct to a floating unit FPSO in accordance with an embodiment of the invention.

The system 1 further comprises a locking mechanism 18 provided at the coupling recipient 4 for locking the coupling adapter 6 of the riser duct 2 upper end 7 against downward withdrawal from the coupling recipient 4, In accordance with one embodiment, which can be referred to as a "hybrid pulling line method" (flexible pipe+steel cable), the system 1 further comprises a pulling line redirecting system 19 installed at the floating unit 3 and comprising at least one curved deviating surface 20 (FIG. 5) along which the pulling line 16 is extended and at which a lower pulling direction 21 of the pulling line 16 at the lower opening 10 of the coupling recipient 4 is deviated into an intermediate pulling direction of the pulling line 16 in a region above the lower opening 10 of the coupling recipient 4.

According to an aspect of the invention, the curved deviating surface 20 is formed by a deviating member 23 directly connected to said coupling recipient 4 and arranged at a radial distance from the recipient longitudinal axis 9 smaller than the radial distance of the annular side wall 8 from the recipient longitudinal axis 9.

This configuration of the pulling line redirecting system 19 places the redirecting point close to or inside the coupling recipient 4, thereby improving the alignment of the riser duct 2 upper end 7 with the coupling recipient 4, and facilitating and/or reducing or even eliminating possible further necessary redirecting of the pulling line 16 between the coupling recipient 4 and the pulling device 14.

For instance, in certain circumstances, the arrangement of the deviation surface 20 directly at or inside the coupling recipient 4 eliminates the need and the installation cost and time of additional external redirecting sheaves.

The improved alignment of the orientation and movement of the riser duct 2 upper end 7 with respect to the coupling recipient 4 longitudinal axis 9 also reduces the number and complexity of submarine operations and corrective interventions carried out by divers.

Detailed Description of the Coupling Recipient 4

Figure 6:
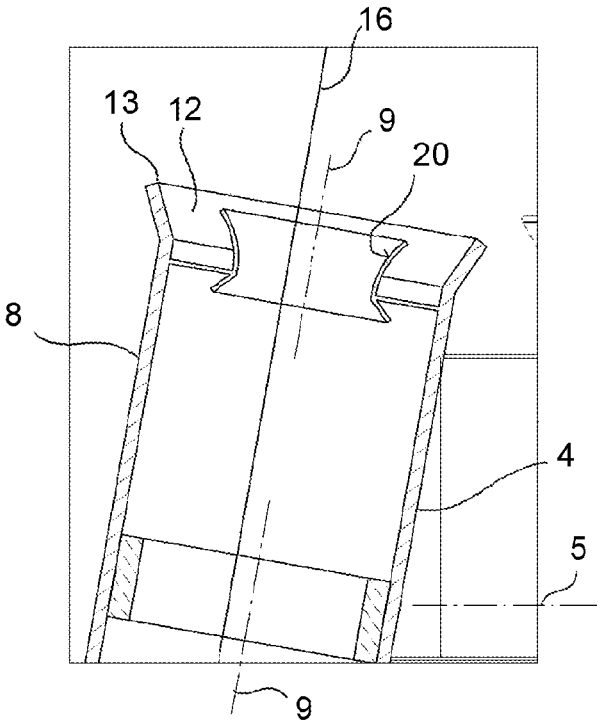
FIG. 6 shows a detail of a coupling recipient of the system in FIG. 5.
Figure 7:
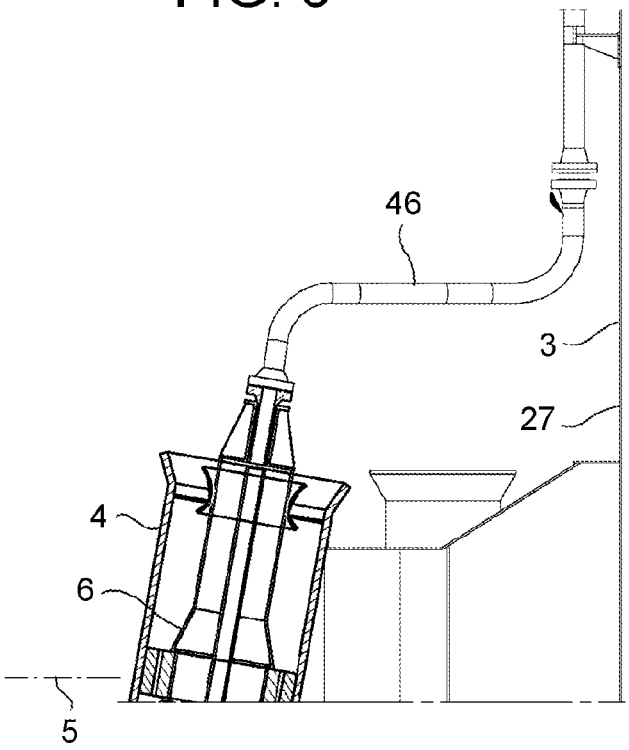
FIG. 7 shows a detail of the system in FIG. 5 in a subsequent method phase in accordance with an embodiment of the invention.
Figure 17:
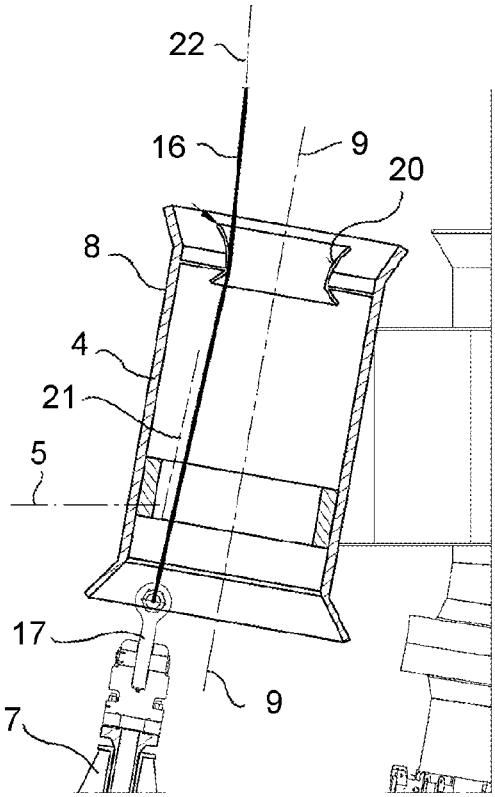
FIGS. 17, 18, 19 show details of the system in FIGS. 13 through 16 in subsequent method phases in accordance with an embodiment of the invention.
Figure 18:
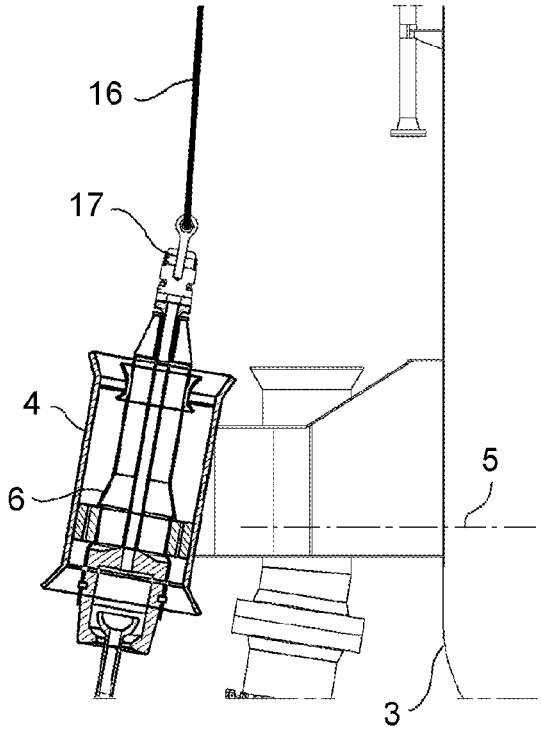
Figure 19:
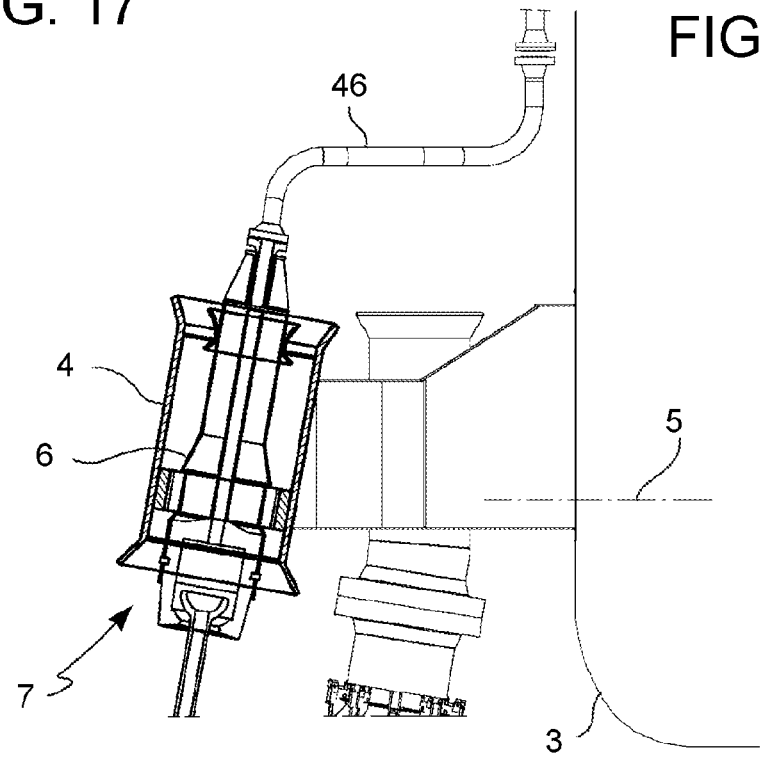
Figure 20:
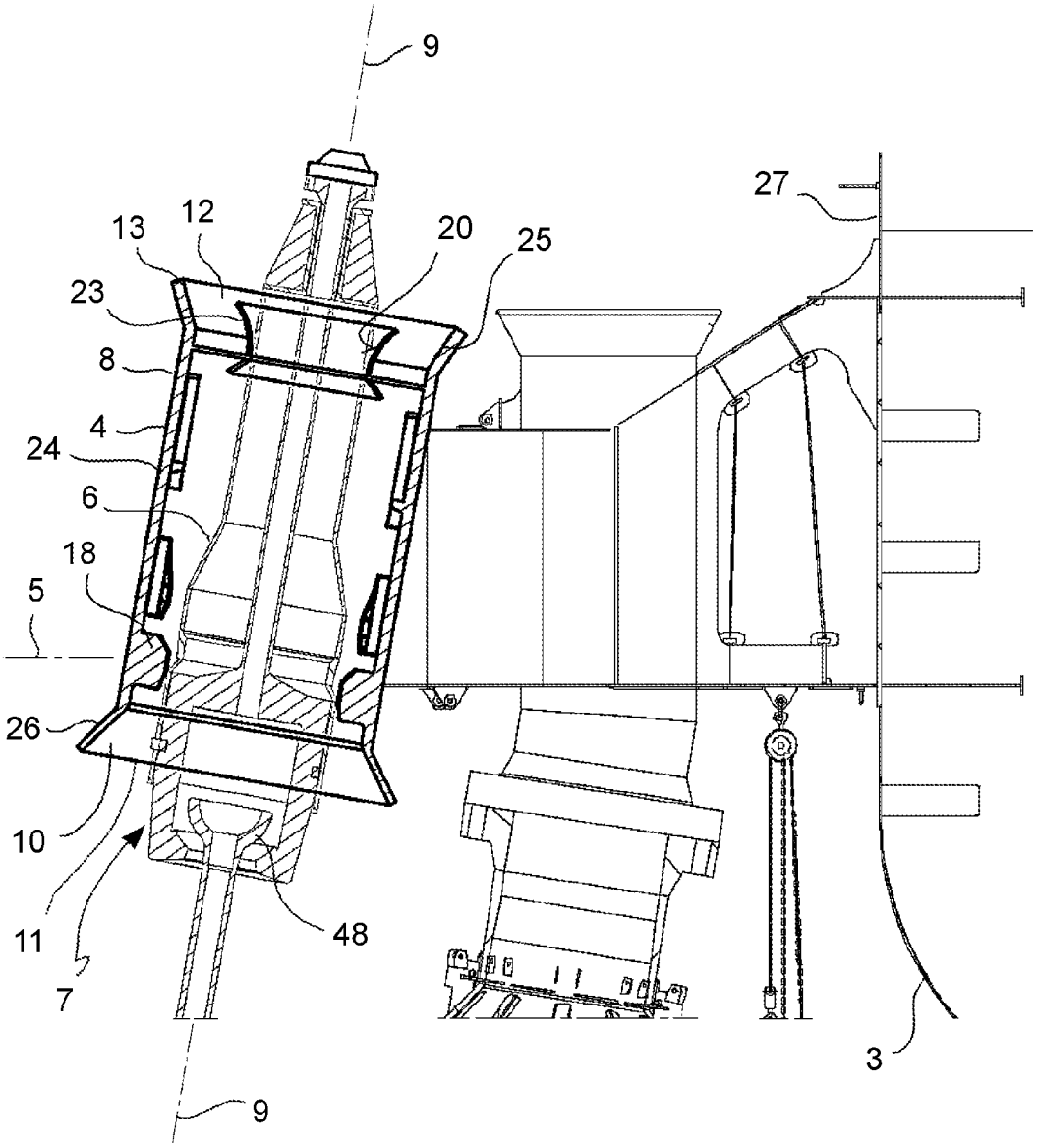
FIG. 20 shows an enlarged detail of a coupling recipient mounted on the floating unit and a corresponding coupling adapter with associated flex joint mounted on an upper end of the riser duct, wherein the coupling adapter is received in the coupling recipient, in accordance with an embodiment.
Figure 26:
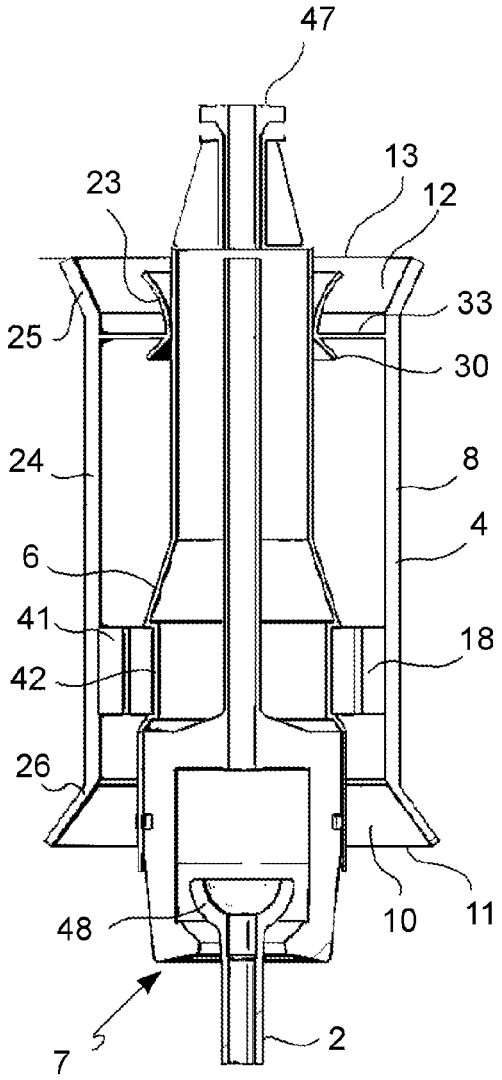
FIG. 26 shows a coupling adapter with associated flex joint mounted on an upper end of the riser duct, wherein the coupling adapter is received in the coupling recipient of FIG. 25, in accordance with an embodiment.
Figure 25:
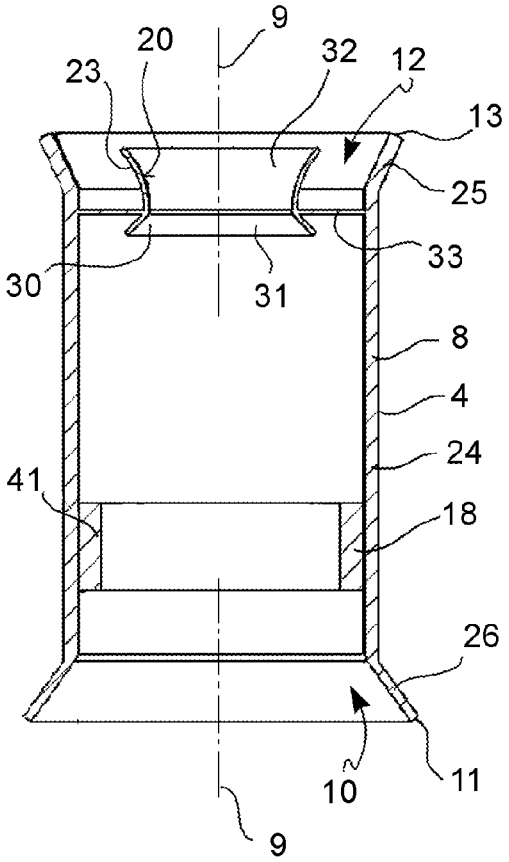
FIG. 25 shows a detail of a coupling recipient in accordance with an embodiment.
Figure 28:
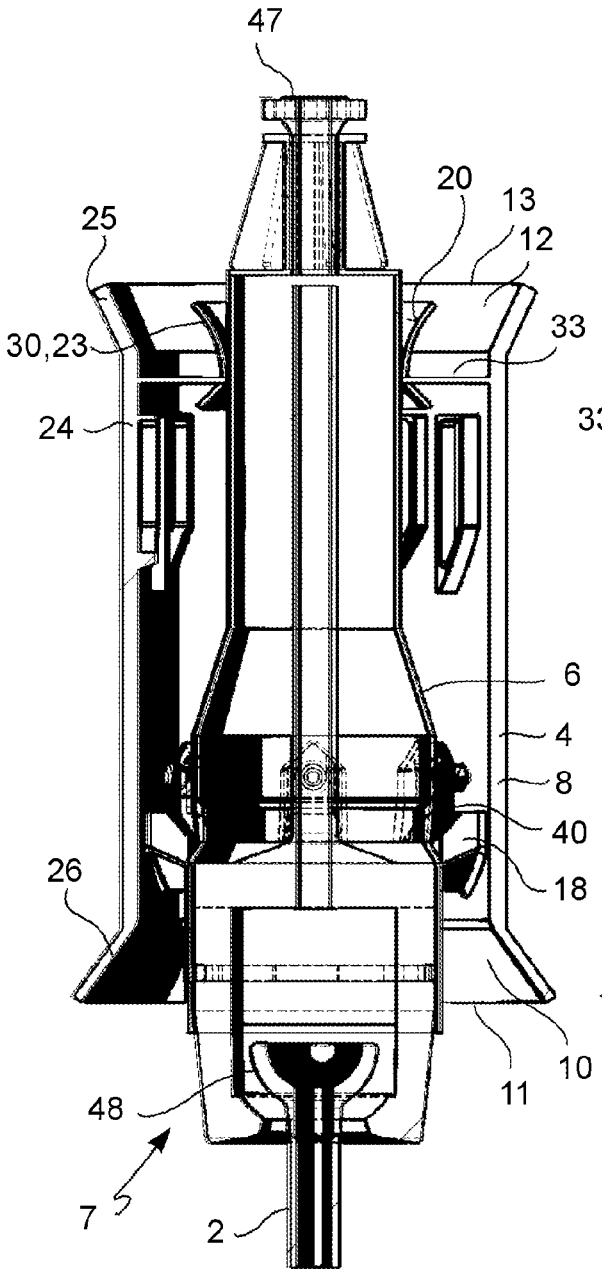
FIG. 28 shows a coupling adapter with associated flex joint mounted on an upper end of the riser duct, wherein the coupling adapter is received in the coupling recipient of FIG. 27, in accordance with an embodiment.
Figure 27:
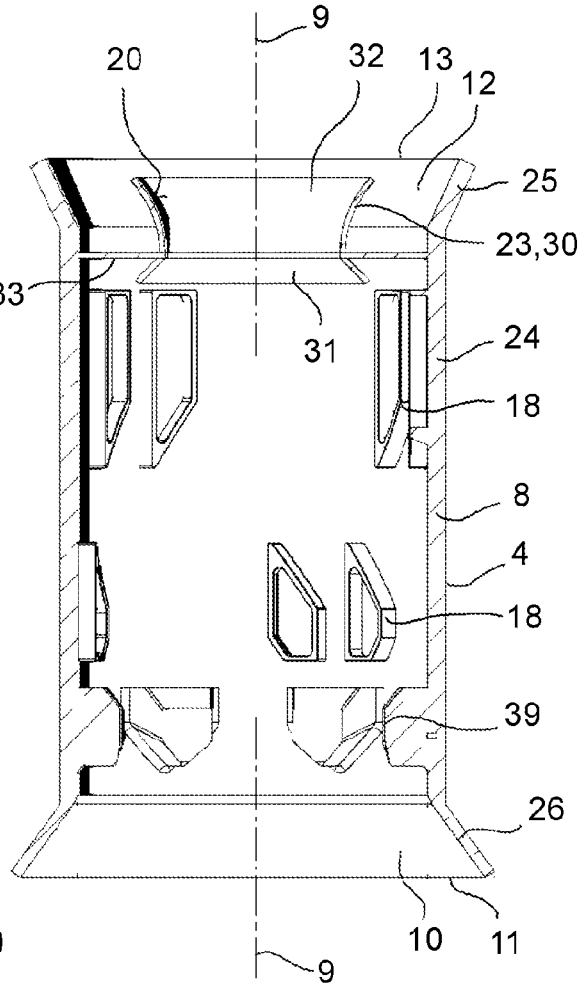
FIG. 27 shows a detail of a coupling recipient in accordance with a further embodiment.

In accordance with embodiments (FIGS. 6, 17, 26), the annular side wall 8 of the coupling recipient 4 is substantially coaxial with the longitudinal axis 9 and may have an intermediate wall portion 24 extending between an upper end portion 25 and a lower end portion 26, in which the intermediate wall portion 24 may have e.g. a circular cylindrical shape or a shape of a cylinder having a polygonal base. The intermediate wall portion 24 may have a substantially constant cross-section or may be tapered, preferably in an upward direction, e.g. by means of a truncated cone shape or a truncated pyramid shape.

The described geometries are convenient, not each one equally in a specific installation condition, but individually with respect to certain aspects of manufacturing, installation and equipping with the locking mechanism 18. For instance, the circular cylindrical shape is conveniently manufactured, the truncated cone shape facilitates the access to the inside of the coupling recipient 4 during mounting the locking mechanism 18, whereas a polygonal cross section can facilitate the alignment of the coupling recipient 4 with respect to the floating unit 3 and provide a geometrical insertion or positioning reference for the coupling adapter 6.

The lower end portion 26 is advantageously flared outward, e.g. by a truncated cone shape or by a truncated pyramid shape. This provides an additional clearance and better visibility at the instance of the riser duct 2 upper end 7 entering the lower opening 10.

The upper end portion 25 is advantageously flared outward, e.g. by a truncated cone shape or by a truncated pyramid shape. This provides an additional clearance and facilitates the lowering of the pulling line 16 or of a messenger cable from above into the upper opening 12 of the coupling recipient 4, even with wind- or wave-induced movements transversal relative movements therebetween.

Advantageously, from a manufacturing and installation point of view, the annular sidewall 8 has an overall shape that is axial-symmetric with respect to the longitudinal axis 9 and mirror symmetric with respect to a middle plane orthogonal to the longitudinal axis 9.

The coupling recipient 4 can be fixed to a vessel side wall 27 of the floating unit 3 with an inclination angle 29 of the longitudinal axis 9 with respect to a vertical vessel direction 28 smaller than 90°, preferably smaller than 60°, even more preferably, smaller than 45°, advantageously in the range of 25° to 0° (i.e. parallel to the vessel vertical direction 28).

The coupling recipient 4 can be inclined with the lower end portion 26 towards the vessel side wall 27 or away from the vessel side wall 27.

The vessel side wall 27 can be a stationary wall of the floating unit 3 or, alternatively, a side wall of a rotating tower (or turret) of the floating unit 3.

The coupling recipient 4 is preferably made in steel and possibly weld connected to the floating unit 3.

Detailed Description of the Deviating Member 23

In accordance with embodiments (FIGS. 6, 17, 26), the deviating member 23 is arranged at least partially, possibly completely, inside the coupling recipient 4. Preferably, the deviating member 23 extends in an upper third or upper fourth or upper sixth of the longitudinal extension of the coupling recipient 4. This is conveniently close to the upper end edge 13 that constitutes a critical point around which the pulling line 16 must be extended without scratching contact, and conveniently remote from a central and lower portion of the coupling recipient 4 where it is convenient to arrange the locking mechanism 18, as will be described further below.

In accordance with an embodiment, the deviating member 23 comprises a static curved deviating wall 30, preferably a ring wall or tubular wall, with an outwardly flared lower entrance section 31 and an opposite outwardly flared upper exit section 32.

The stationary deviating wall 30 has a continuous, preferably step-less and edge-less, curvature both in a circumferential direction of the coupling recipient 4 and in a longitudinal direction of the coupling recipient 4 with respect to the longitudinal axis 9, with a possible exception of a single circumferential, obtuse angled, edge in a transition region between the lower entrance section 31 and the upper exit section 32. The deviating surface 20 is formed on a radially internal side of the stationary deviating wall 30.

The deviating surface 20 can hence have a continuous concave curvature in a circumferential direction of the coupling recipient 4 and a continuous convex curvature in a longitudinal direction of the coupling recipient 4.

In a preferred embodiment, mainly from a manufacturing and installation position point of view, the deviating wall 30 and/or the deviating surface 20 is coaxial with respect to the annular side wall 8. Yet more preferably, the deviating wall 30 and/or the deviating surface 20 is axial-symmetric with respect to the longitudinal axis 9.

The deviating wall 30 can be most conveniently fixed at or inside the coupling recipient 4 by means of one or more fixation walls 33 extending from an internal surface of the annular side wall 8 to an external surface of the deviating wall 30.

In the preferred embodiment illustrated in the figures (e.g. FIG. 26), there is only one single planar fixation wall 33 extending in a plane orthogonal to the longitudinal axis 9, preferably at a transition region between the intermediate wall portion 24 and the upper end portion 25, but even more preferably still within a longitudinal extension of the intermediate wall portion 24.

In accordance with alternative embodiments, the deviating member 23 may comprise one or more rotatable pulleys or roller members supported by the annular side wall 8, preferably in the deviating positions described above.

The deviating member 23 is preferably made in steel and possibly weld connected to the coupling recipient 4.

Detailed Description of the Redirecting System 19

In accordance with embodiments (FIGS. 5, 8, 9, 11), the redirecting system 19 may comprise additional one or more deviation gutters (also called deviation sheaves) 34, connected or reversibly temporarily connectable, on the vessel side wall 27 above the coupling recipient 4 and at a vertical distance from the coupling recipient 4, but below the pulling device 14. These additional deviation gutters 34 are adapted to further redirect the pulling line 16 in one or more additional redirecting points above the deviating member 23 and below the pulling device 14.

The additional deviating sheave 34 may comprise a support frame 35 and one or more curved auxiliary deviation surfaces 36 or rotatable deviating pulleys (not shown in the figures) supported by support frame 35 and along which the pulling line 16 is extended.

Detailed Description of the Pulling Device 14

The pulling device 14 may comprise one or more motor driven pulling winches 37 adapted to wind on and off an upper portion of the pulling line 16, as well as possibly one or more deviating surfaces, e.g. pulleys, and locking devices 38 adapted to stop and secure the pulling device 14 and, hence, the pulling line 16 in a desired position.

In accordance with embodiments, the pulling device 14 or the pulling winch 37 is displaceable, e.g. slidable, to a plurality of different pulling positions above a plurality of different of said coupling recipients 4.

Detailed Description of the Locking Mechanism 18

In accordance with embodiments (FIGS. 25 through 28), the locking mechanism 18 is arranged at least partially, possibly completely, inside the coupling recipient 4. Preferably, the locking mechanism 18 extends in a lower two third, in a lower half or in a lower third of the longitudinal extension of the coupling recipient 4. This is conveniently close to the lower end edge 13 that constitutes a critical point that must not be hit by the riser duct 2 or by the flex joint of the riser duct 2 upper end 7 during flexing movements of the riser duct 2 upper end 7. Moreover, the proposed position of the locking mechanism 18 is conveniently far from the deviating member 23 in the upper stretch of the coupling recipient 4.

In accordance with an embodiment, the locking mechanism 18 comprises one or more latch portions 39 protruding inward from an internal surface of the annular side wall 8 and adapted to cooperate with corresponding hook portions 40 formed at an external surface of the coupling adapter 6 so as to produce a shape coupling between the latch portions 39 and the hook portions 40.

The locking mechanism 18 can e.g. define a labyrinth path of the coupling adapter 6 into the coupling recipient 4 with:

- an initial translating movement of the coupling adapter 6 in a first angular insertion position that allows the coupling adapter 6 to penetrate into the coupling recipient 4,
- a subsequent rotatory-translating motion of the coupling adapter 6 into a second angular latching position with respect to the coupling recipient 4, wherein the second angular latching position is offset with respect to the first angular insertion position, and wherein in said second angular latching position the coupling adapter 6 is prevented from being withdrawn out of the coupling recipient 4.

A similar locking mechanism is known e.g. from U.S. Pat. No. 7,373,986 and commercially available under the tradename "Rotolatch™".

In accordance with a further embodiment, the locking mechanism 18 includes an arch shaped first locking protrusion 41 arranged at the internal side of the coupling recipient 4 and adapted to engage, by relative motion and shape coupling, an arch shaped second locking protrusion 42 arranged at an external side of the coupling adapter 6.

Advantageously, the locking mechanism is self activating upon insertion of the coupling adapter 6 into the coupling recipient 4 or it can be activated by remote control.

According to a further aspect of the invention (FIGS. 8 to 12), at least a lower end section 43 of the pulling line 16, adjacent to the riser duct 2 upper end 7, is configured as a flexible tubular pull-resistant duct 44, adapted for conveying the petroleum product from the riser duct 2 upper end 7 to a production storage offloading facility 45 onboard the floating unit 3, so that after locking the coupling adapter 6 in the coupling recipient 4, no need arises to detach the lower end section 43 of the pulling line 16 from the riser duct 2 and replace it by a different rigid ducting 46 (the so-called spool duct).

This eliminates a considerable amount of time consuming operations, particularly submarine operations carried out by divers, and interventions that require highly experienced workforce.

In accordance with an embodiment, the flexible duct 44 can comprise e.g. an unbonded flexible pipe, a bonded flexible pipe or a TCP (Thermoplastic Composite Pipe).

The flexible duct 44 can be directly attached to a top end flange of e flexible joint 48 of the riser duct 2 upper end 7. The flexible duct 44 fluidically communicates the riser upper termination with the dry deck of the FPSO floating unit 3, therefore allowing all preparatory and complementary operations to be carried out without the utilization of divers.

Figure 8:
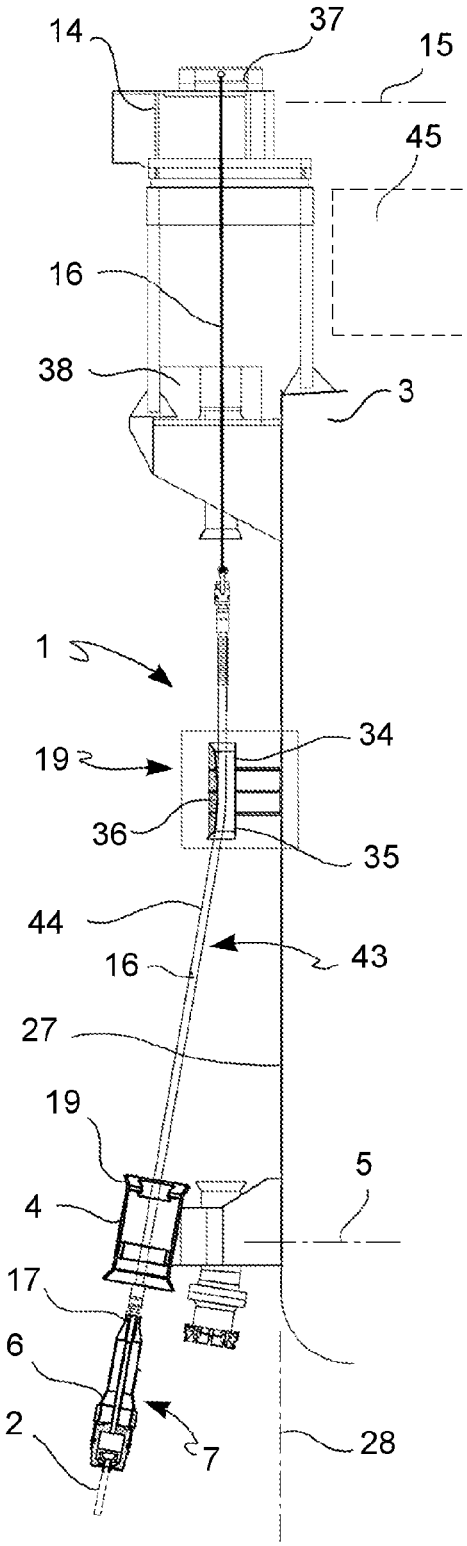
FIGS. 8 and 9 show method phases and a system for approximating and connecting an off shore riser duct to a floating unit FPSO in accordance with a further embodiment of the invention.
Figure 9:
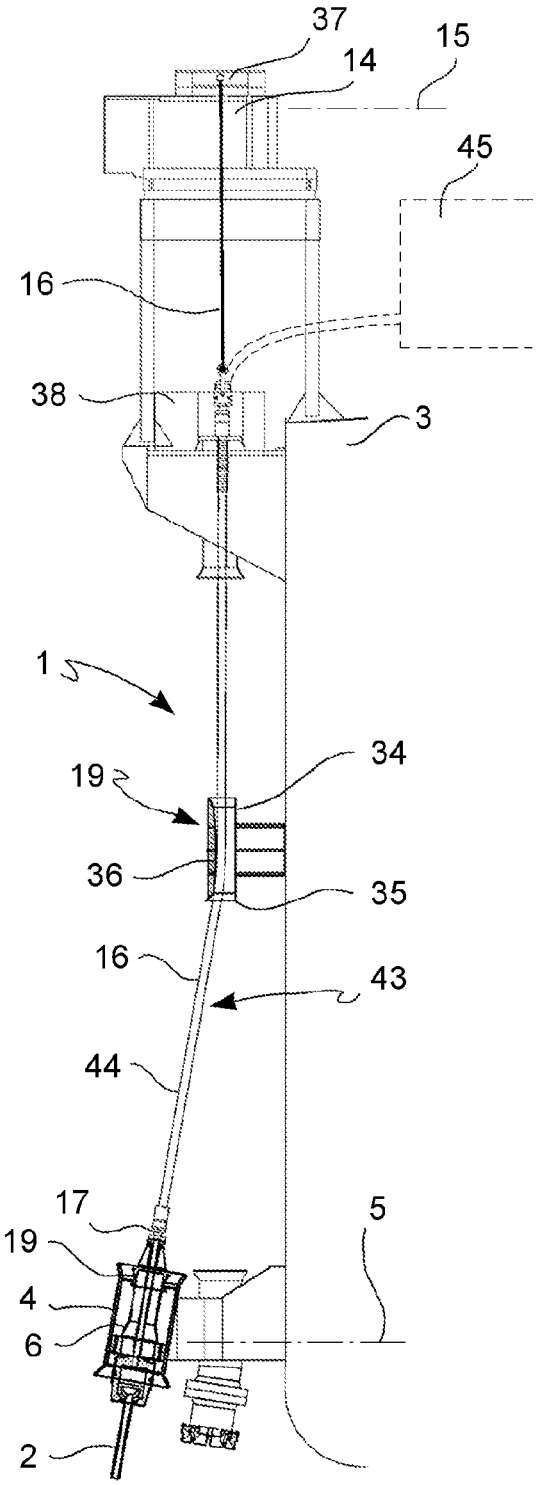
Figure 13:
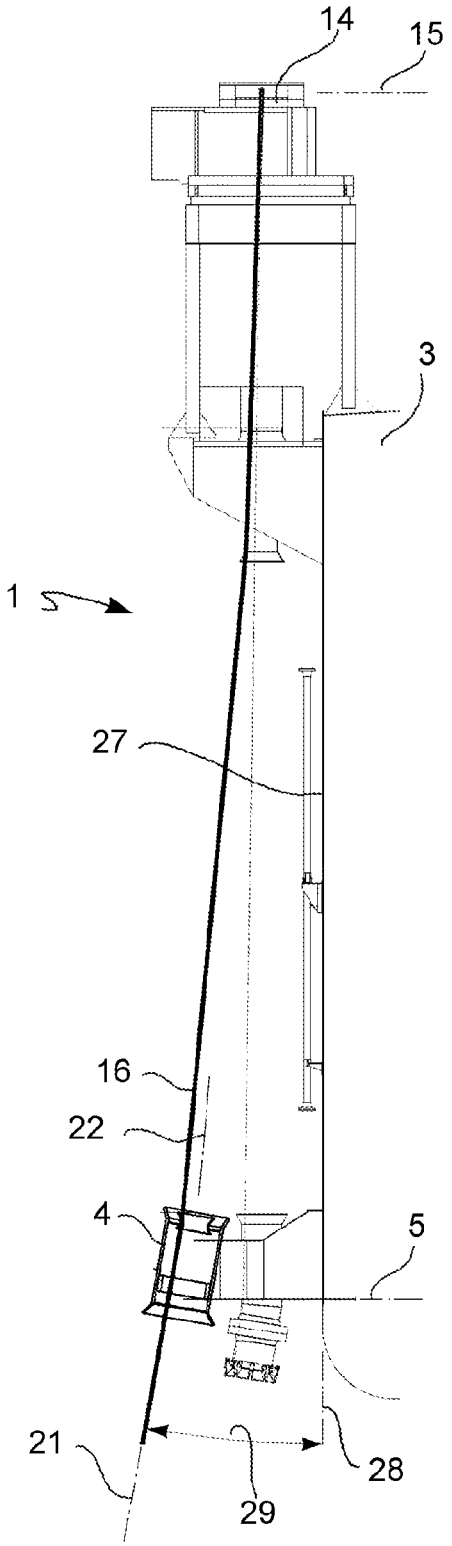
FIGS. 13 through 16 show method phases and a system for approximating and connecting an off shore riser duct to a floating unit FPSO in accordance with a further embodiment of the invention.
Figure 14:
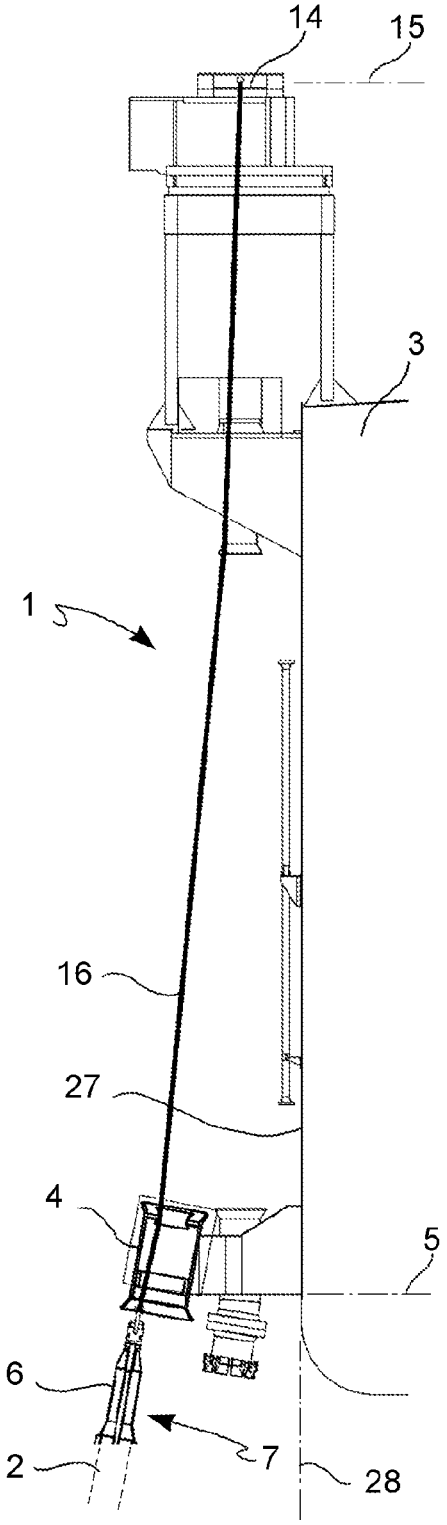
Figure 15:
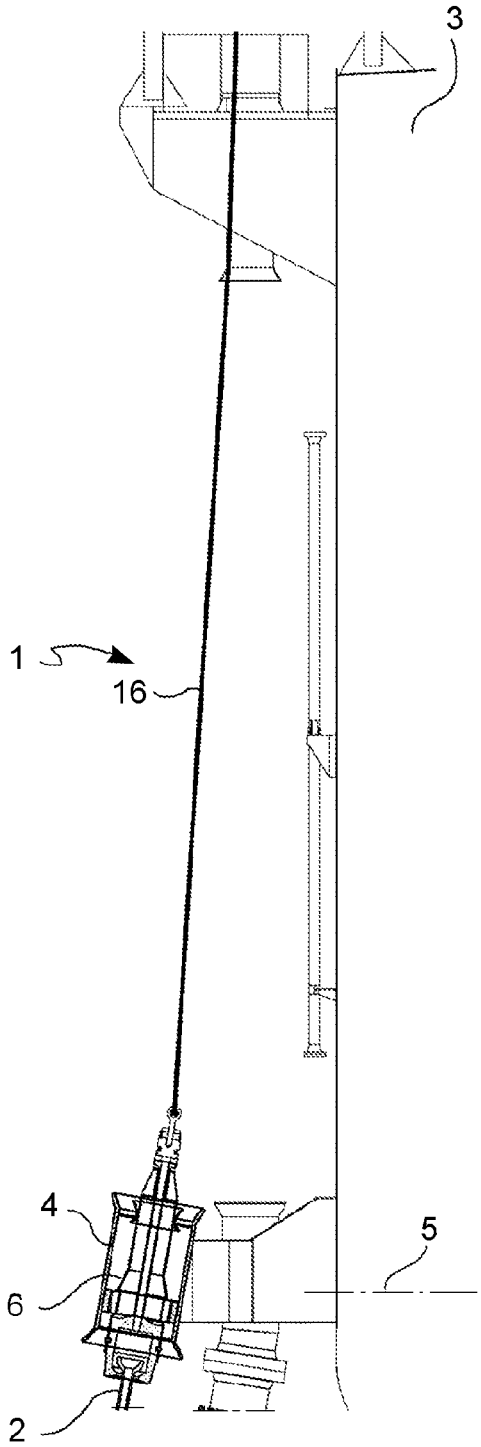

Advantageously, in order to obtain a permanent fixation of the thus obtained conduit connection, an additional deviating sheave 34 is positioned at the vessel side wall 27 in a region above the coupling recipient 4 and below the dry deck of the FPSO floating unit 3, and the pulling line 16 with the flexible duct 44 section is extended through said additional deviating sheave 34 (FIGS. 8, 9).

Detailed Description of the Riser Duct 2

Figure 23:
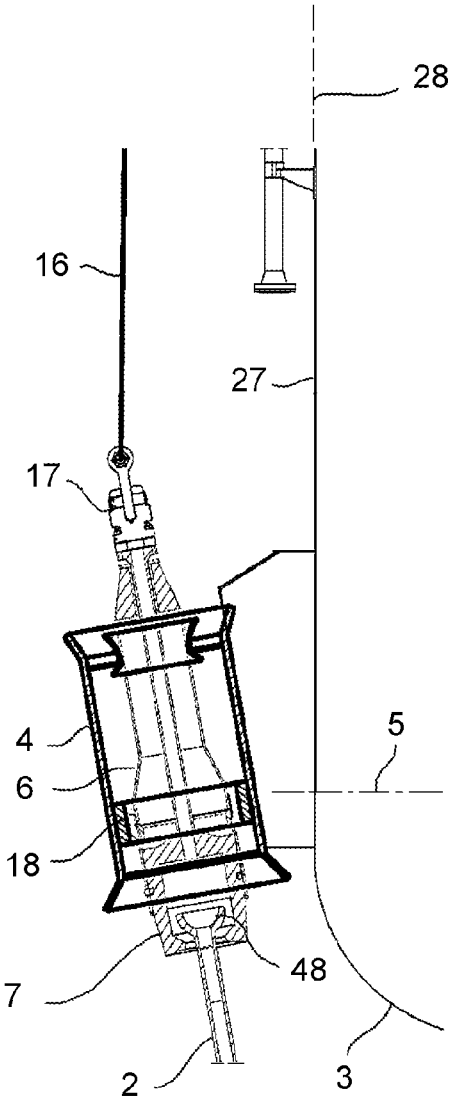
Figure 24:
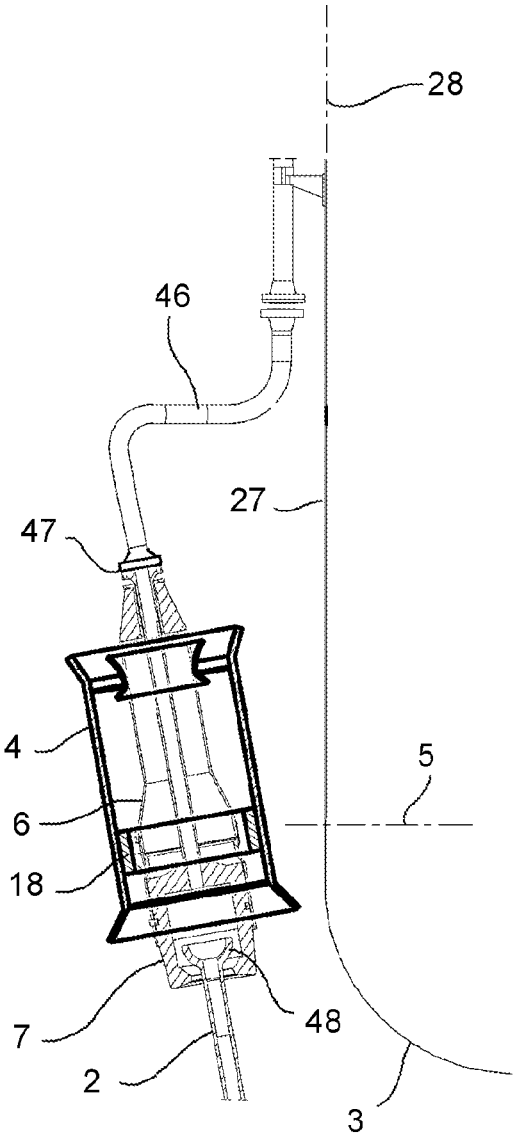

In accordance with an embodiment, the riser duct 2 may be a rigid riser duct with an upper end 7 which includes a pulling head 17 for the connection of the pulling line 18 or of a generic pulling cable, the coupling adapter 6 and a (per se known) flexible joint 48 (FIGS. 23, 24, 25) which accommodates relative flexural movements between (the coupling adapter 6 fixed to the coupling recipient 4 at) the floating unit 3 and the riser 2.

Detailed Description of the Method

With reference to the figures, a method for approximating and connecting an off shore riser duct 2 to a floating unit FPSO 3 comprises:

installing a tubular coupling recipient 4 (I-tube) on the floating unit 3 at a riser coupling level 5, said coupling recipient 4 having an annular side wall 8 extending around a recipient longitudinal axis 6, positioning a pulling device 14 on the floating unit 3 at a pulling device level 15 above said riser coupling level 5 and using the pulling device 14 to pull a pulling line 16 extended through the coupling recipient 4 and connected to a pulling head 17 at an upper end 7 of the riser duct 2, so that the upper end 7 of the riser duct 2 is pulled from below upward into the coupling recipient 4, providing a locking mechanism 18 at the coupling recipient 4 and using the locking mechanism 18 for locking the coupling adapter 6 of the riser duct 2 upper end 7 against downward withdrawal from the coupling recipient 4, deviating a pulling direction 21 of the pulling line 16 by extending the pulling line 16 along at least one curved deviating surface 20 formed by a deviating member 23 directly connected to said coupling recipient 4 and arranged at a radial distance from said recipient longitudinal axis 9 smaller than a radial distance of said annular side wall 8 from the recipient longitudinal axis 9.

In accordance with an embodiment, during approximation and insertion of the riser duct 2 upper end 7 toward and into the coupling recipient 4, the pulling line 16 is extended through the coupling recipient 4 and, optionally, through one or more of the additional deviation gutters 34. After locking the coupling adapter 6 in the coupling recipient 4, the pulling line 16, e.g. a steel pulling cable, is detached from the upper end 7 of the riser 2 and a spool duct 46 (or pipe connection socket) is connected to the upper end 7 of the riser duct 2 for making a permanent hydraulic connection between the riser duct 2 and the onboard oil or gas plant FPSO 45 of the floating unit 3.

In accordance with an alternative, highly advantageous embodiment, the method comprises:

configuring at least a lower end section 43 of the pulling line 16, adjacent to the riser duct 2 upper end 7, as a flexible tubular pull-resistant duct 44 and after locking the coupling adapter 6 in the coupling recipient 4, using the lower end section 43 of the pulling line 16 for conveying the petroleum product from the riser duct 2 to the production storage offloading facility 45 onboard the floating unit 3.

The described system 1 and method allows to extensively automatically carrying out the entire connection phase of the riser duct 2 to the floating unit 3 and reduces or eliminates the need of operations and interventions by divers. A better safety at work is achieved by the elimination of certain manual interventions carried out by divers near the pulling line and by reducing or eliminating the placement of heavy redirecting pulleys underwater at the floating unit 3.

Time savings are achieved due to the speeding up of the reconfiguration of the pulling system, since the principal redirecting is assigned to the built-in deviating member 23.

In some embodiments a pulling cable is replaced by the flexible duct 44 that performs the function of the spool duct 46, hence eliminating the spool duct 46 installation operations which are normally performed by divers and which require metrology, construction and installation.

The system 1 and method are suitable for installation sequences of risers of different structural configurations and allow sequences of pull-in/hang out of risers of different types (full-flexible, rigid risers, etc.) without modification of the pulling components and pulling methodology.

The system 1 and method are less sensitive to weather and sea conditions, due to the reduced or completely eliminated operations which require diver, which can become crucial in emergency procedures requiring the removal of the riser ducts 2 from the floating unit 3.

The system 1 and method allow a better control of the installation operations because the deviating member 23 at or inside the I-tube coupling recipient 4 is very close to the riser locking location, improving pulling cable guidance and orientation.

Figure 16:
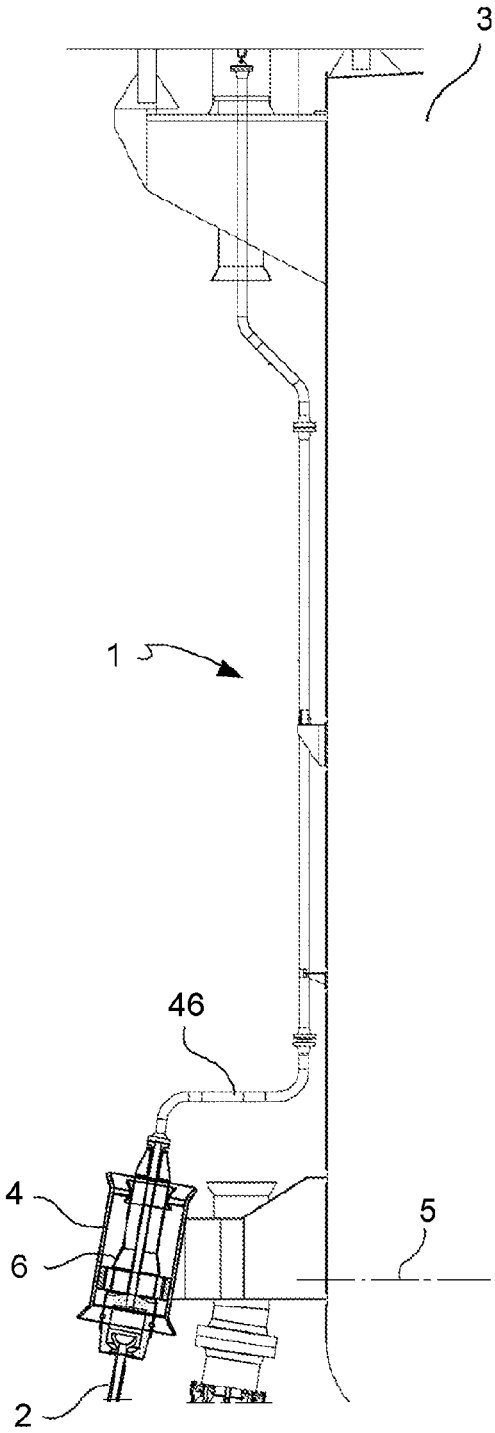
Figure 21:
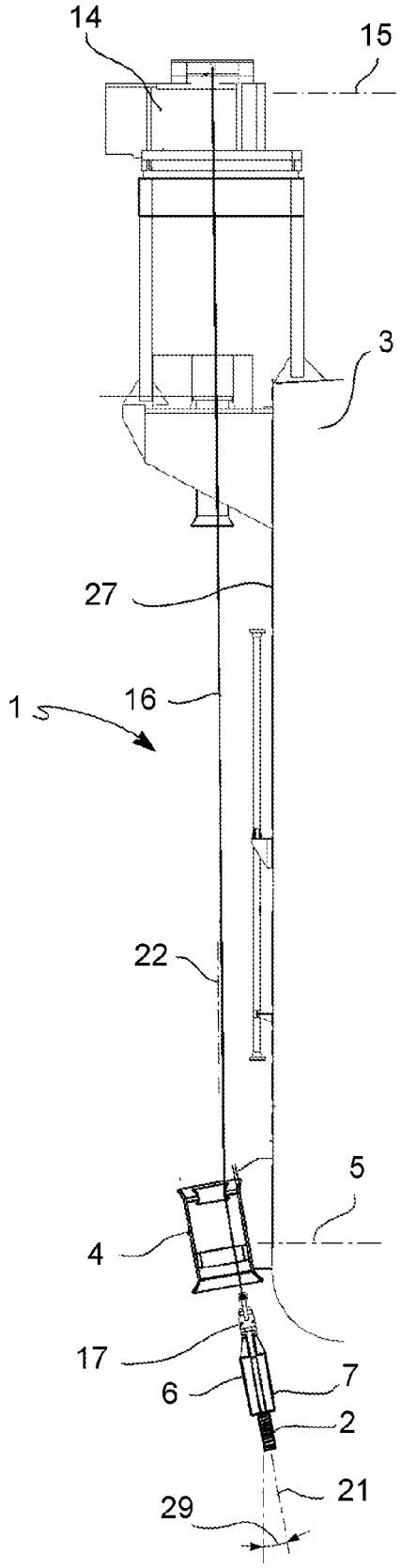
FIG. 21 shows a method phase and a system for approximating and connecting an off shore riser duct to a floating unit FPSO in accordance with a yet further embodiment of the invention.
Figure 22:
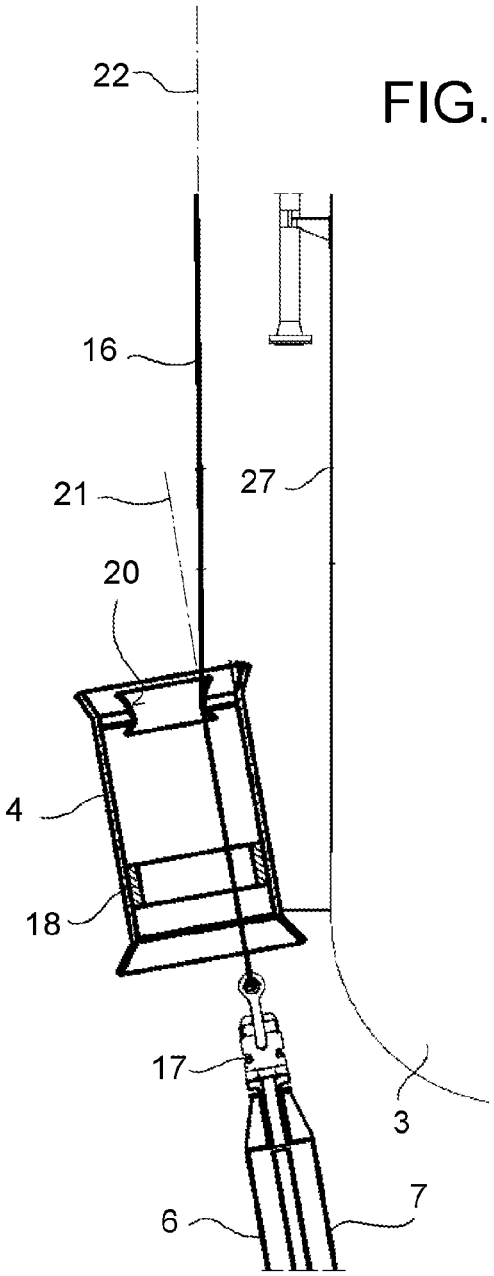
FIGS. 22, 23, 24 show details of the system in FIG. 21 in subsequent method phases in accordance with an embodiment of the invention.

The system and method also allow the substitution of a hard pipe installed by divers (compare FIG. 16, ref. 46) by a diverless flexible spool installation (compare FIG. 9, ref. 16, 43, 44). In addition, the method and system also allows keelhauling pull-in without the need of additional devices (compare FIGS. 21 and 22).

While the present invention has been illustrated by description of several embodiments and while the illustrative embodiments have been described in considerable detail, it is not the intention to restrict or in any way limit the scope of the appended claims to such detail. Additional advantages and modifications may readily appear to those skilled in the art.

The invention claimed is:

1. System for approximating and connecting an off shore riser duct to a floating unit, comprising:

a tubular coupling recipient installed on the floating unit at a riser coupling level and adapted to receive a coupling adapter of an upper end of said riser duct, said coupling recipient having an annular side wall extending about a recipient longitudinal axis, a downward facing lower opening defined by a lower end edge of the side wall, an upward facing upper opening defined by an upper end edge of the side wall, a puller installed on the floating unit at a puller level above said riser coupling level and adapted to pull a pulling line extended through the coupling recipient, wherein the pulling line configured to couple to a pulling head at the upper end of the riser duct, so that the upper end of the riser duct is pulled from below upward into the coupling recipient, a lock provided at the coupling recipient for locking the coupling adapter of the riser duct upper end against downward withdrawal from the coupling recipient, a pulling line redirecting system comprising at least one curved deviating surface along which the pulling line is extended and at which a lower pulling direction of the pulling line at the lower opening of the coupling recipient is adapted to deviate into an intermediate pulling direction of the pulling line in a region above said lower opening, wherein the curved deviating surface is formed by a member directly connected to said coupling recipient and arranged at a radial distance from the recipient longitudinal axis smaller than a radial distance of the annular side wall from the recipient longitudinal axis.

2. System according to claim 1, in which the member is arranged at least partially inside the coupling recipient.

3. System according to claim 1, in which the member extends in an upper third of a longitudinal extension of the coupling recipient.

4. System according to claim 1, in which the member comprises a stationary curved tubular deviating wall with an outwardly flared lower entrance section and an opposite outwardly flared upper exit section.

5. System according to claim 4, in which the stationary deviating wall has a continuous curvature both in a circumferential direction of the coupling recipient and in a longitudinal direction of the coupling recipient with respect to the longitudinal axis, and in which the deviating surface is formed on a radially internal side of the stationary deviating wall.

6. System according to claim 1, in which the deviating surface has a continuous concave curvature in a circumferential direction of the coupling recipient and a continuous convex curvature in a longitudinal direction of the coupling recipient.

7. System according to claim 1, in which the deviating surface is coaxial with respect to the annular side wall.

8. System according to claim 1, in which the deviating surface is axial-symmetric with respect to the longitudinal axis.

9. System according to claim 4, in which the deviating wall is fixed at the coupling recipient by one or more fixation walls extending from an internal surface of the annular side wall to an external surface of the deviating wall.

10. System according to claim 4, in which said coupling recipient comprises only one single planar fixation wall extending in a plane orthogonal to the longitudinal axis.

11. System according to claim 1, in which the member comprises one or more rotatable pulleys or rollers supported by the annular side wall.

12. System according to claim 1, in which the annular side wall of the coupling recipient is substantially coaxial with the longitudinal axis and has an upper end portion and a lower end portion and an intermediate wall portion extending between the upper end portion and the lower end portion, and in which at least one of the lower end portion and the upper end portion is flared outward.

13. System according to claim 12, in which the intermediate wall portion has a shape selected from the group consisting of:

a circular cylindrical shape,
a shape of a cylinder having a polygonal base,
a substantially constant cross-section shape,
a tapered shape,
a shape tapered in an upward direction,
a truncated cone shape,
a truncated pyramid shape.

14. System according to claim 12, in which the annular sidewall has an overall shape that is axial-symmetric with respect to the longitudinal axis and mirror symmetric with respect to a middle plane orthogonal to the longitudinal axis.

15. System according to claim 1, in which the coupling recipient is fixed to a vessel side wall of the floating unit with an inclination angle of the longitudinal axis with respect to a vertical vessel direction smaller than 60°.

16. System according to claim 15, in which the vessel side wall is a stationary wall of the floating unit.

17. System according to claim 15, in which the vessel side wall is a side wall of a rotating tower of the floating unit.

18. System according to claim 1, in which the redirecting system comprises additional one or more deviation gutters, connected or connectable, on a vessel side wall of the floating unit above the coupling recipient and at a vertical distance from the coupling recipient, but below the puller, in which the additional one or more deviation gutters are adapted to further redirect the pulling line in one or more additional redirecting points above the member and below the puller.

19. System according to claim 1, in which the puller comprise a motor driven pulling winch adapted to wind on and off an upper portion of the pulling line, and a locking device adapted to stop and secure the pulling line in a desired position.

20. System according to claim 1, in which the puller is displaceable to a plurality of different pulling positions above a plurality of different of said coupling recipients.

21. System according to claim 1, in which the lock is arranged at least partially inside the coupling recipient.

22. System according to claim 1, in which the lock extends in a lower two thirds of the longitudinal extension of the coupling recipient.

23. System according to claim 1, in which the lock comprises one or more latch portions protruding inward from an internal surface of the annular side wall and adapted to cooperate with corresponding hook portions formed at an external surface of the coupling adapter to produce a shape coupling between the latch portions and the hook portions.

24. System according claim 1, in which the lock forms a labyrinth path for movement of the coupling adapter into the coupling recipient, said labyrinth path producing:

an initial translating movement of the coupling adapter in a first angular insertion position that allows the coupling adapter to penetrate into the coupling recipient, a subsequent rotatory-translating motion of the coupling adapter into a second angular latching position with respect to the coupling recipient, wherein the second angular latching position is offset with respect to the first angular insertion position, wherein in said second angular latching position the coupling adapter is prevented from being withdrawn out of the coupling recipient.

25. System according to claim 1, in which the lock includes an arch shaped first locking protrusion arranged at an internal side of the coupling recipient and adapted to engage, by relative motion and shape coupling, an arch shaped second locking protrusion arranged at an external side of the coupling adapter.

26. System according to claim 1, in which the lock is self-activating upon insertion of the coupling adapter into the coupling recipient.

27. System according to claim 1, in which at least a lower end section of the pulling line, adjacent to the riser duct upper end, is configured as a flexible tubular pull-resistant duct, adapted for conveying a petroleum product from the riser duct upper end to a production storage offloading facility onboard the floating unit.

28. System according to claim 27, in which the flexible duct is selected from the group consisting of:

an unbonded flexible pipe,
a bonded flexible pipe,
a thermoplastic composite pipe.

29. System according to claim 27, in which the flexible duct is attached to a top end flange of a flexible joint of the riser duct upper end.

30. Method for approximating and connecting an off shore riser duct to a floating unit, comprising:

installing a tubular coupling recipient on the floating unit at a riser coupling level, said coupling recipient having an annular side wall extending around a recipient longitudinal axis, positioning a puller on the floating unit at a puller level above said riser coupling level and using the puller to pull a pulling line extended through the coupling recipient and connected to a pulling head at an upper end of the riser duct, so that the upper end of the riser duct is pulled from below upward into the coupling recipient, providing a lock at the coupling recipient and using the lock for locking a coupling adapter of the riser duct upper end against downward withdrawal from the coupling recipient, deviating a pulling direction of the pulling line by extending the pulling line along at least one curved deviating surface, wherein said curved deviating surface is formed by a member directly connected to said coupling recipient and arranged at a radial distance from said recipient longitudinal axis smaller than a radial distance of said annular side wall from the recipient longitudinal axis.

31. Method according to claim 30, comprising:

after locking the coupling adapter in the coupling recipient, connecting a spool duct to the upper end of the riser duct for making a permanent hydraulic connection between the riser duct and an onboard oil or gas plant of the floating unit.

32. Method according to claim 30, comprising:

configuring at least a lower end section of the pulling line, adjacent to the riser duct upper end, as a flexible tubular pull-resistant duct, and after locking the coupling adapter in the coupling recipient, using the same lower end section of the pulling line for making a permanent hydraulic connection between the riser duct and an onboard oil or gas plant of the floating unit.

* * * * *